United States Patent [19]

Clark

[11] Patent Number: 4,563,790

[45] Date of Patent: Jan. 14, 1986

[54] HOSE ATTACHMENT STRUCTURE FOR UPRIGHT VACUUM CLEANER

[75] Inventor: Paul M. Clark, St. Paul, Minn.

[73] Assignee: Whirlpool Corporation, Benton Harbor, Mich.

[21] Appl. No.: 601,542

[22] Filed: Apr. 18, 1984

[51] Int. Cl.[4] ..... A47L 5/32

[52] U.S. Cl. ..... 15/337

[58] Field of Search ..... 15/331, 334, 337

[56] References Cited

U.S. PATENT DOCUMENTS

| | | | |
|---|---|---|---|
| 1,527,377 | 2/1925 | Orr | 15/337 |
| 1,933,629 | 11/1933 | Kitto | 15/337 |
| 2,126,396 | 8/1938 | Kitto | 15/337 |

FOREIGN PATENT DOCUMENTS

| | | | |
|---|---|---|---|
| 928488 | 2/1955 | Fed. Rep. of Germany | 15/337 |
| 148853 | 2/1955 | Sweden | 15/337 |

*Primary Examiner*—Chris K. Moore

*Attorney, Agent, or Firm*—Wood, Dalton, Phillips, Mason & Rowe

[57] ABSTRACT

According to the invention, a hose attachment port is provided in the hood of an upright suction cleaner. A hinged door is spring biased sealingly against the underside of the hood to seal the port for on-the-floor operation. The door is pivotable upon the insertion of a converter to a second position, which blocks air communication between a chamber housing a rotary agitator and an air passageway penetrated by the converter. With the door in the second position, suction generated by the cleaner is entirely realized in a hose attached to the converter. Latch means are also provided to releasably secure the converter with the hood.

20 Claims, 6 Drawing Figures

FIG. 1
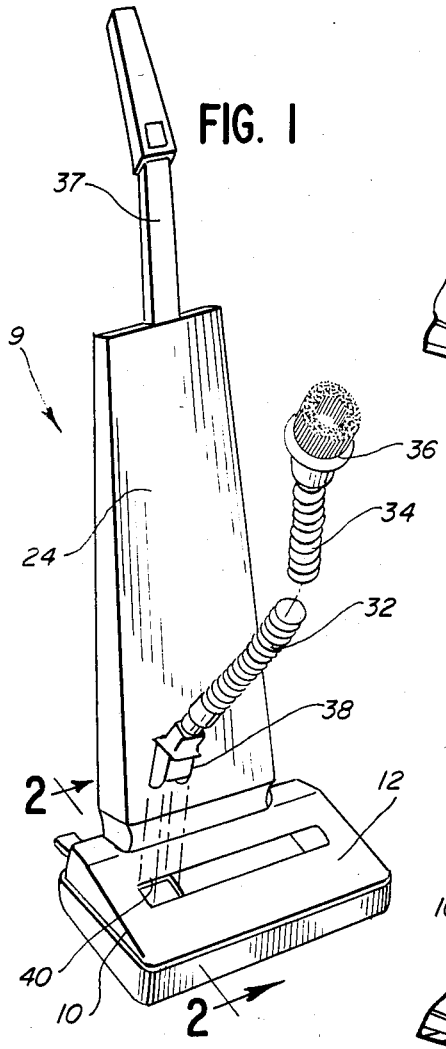
FIG. 2
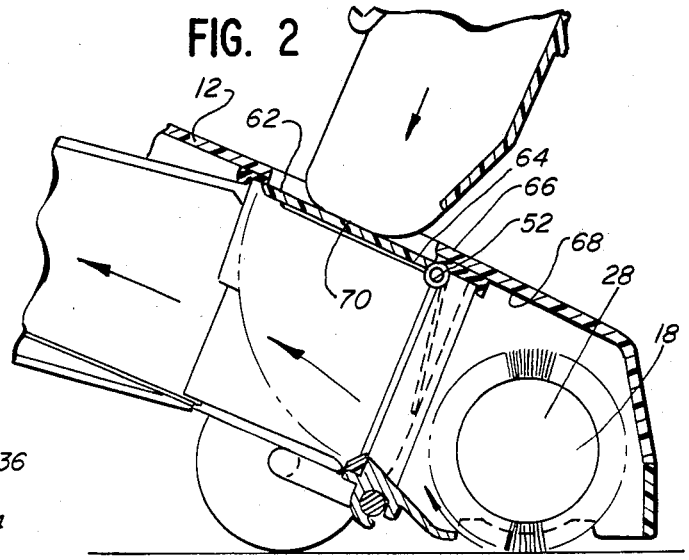
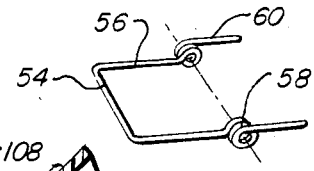
FIG. 4
FIG. 3
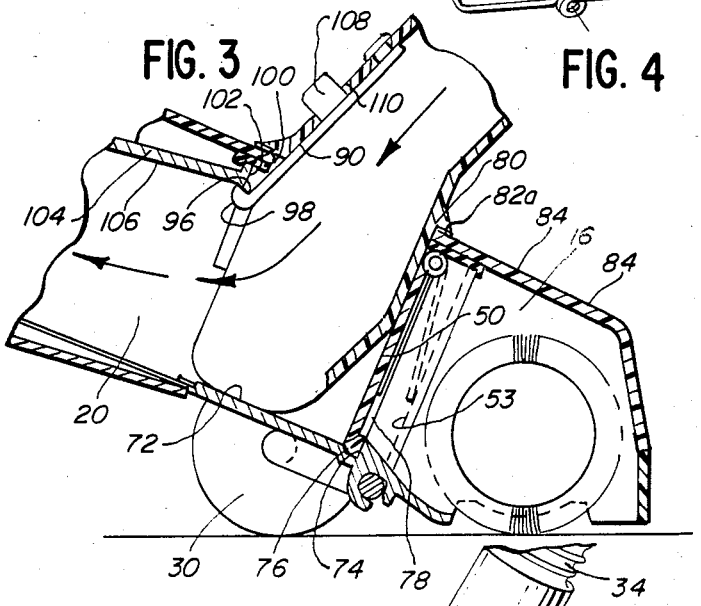
FIG. 5
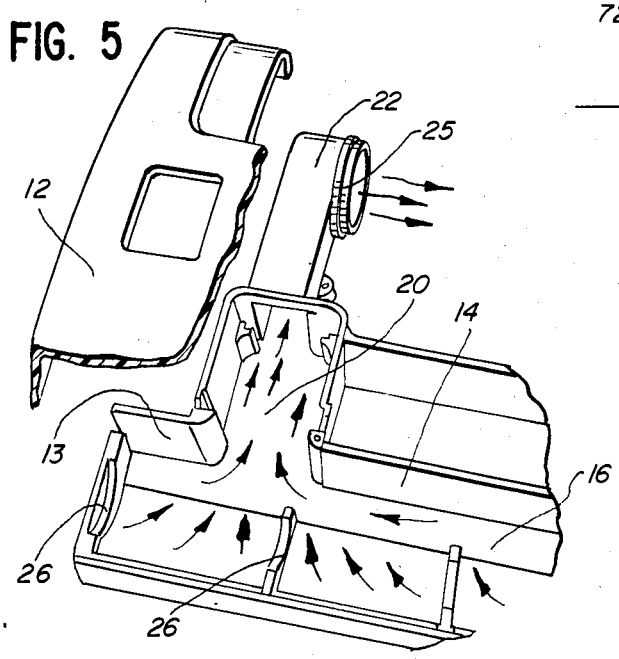
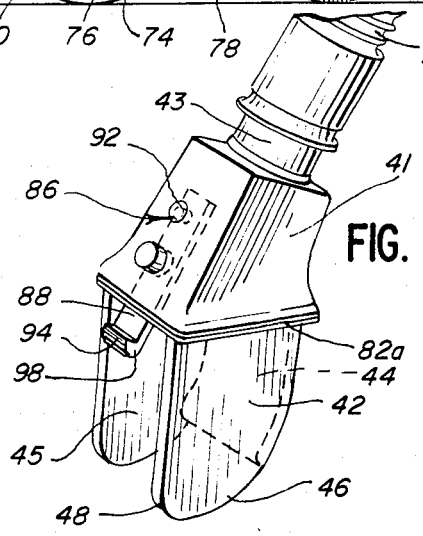
FIG. 6

HOSE ATTACHMENT STRUCTURE FOR UPRIGHT VACUUM CLEANER

BACKGROUND OF THE INVENTION

1. Field of the Invention

This invention relates to suction cleaning apparatus and, more particularly, to a structure facilitating conversion between on-the-floor and off-the-floor suction cleaning therewith.

2. Description of the Prior Art

Upright suction cleaners with provision for accessories for cleaning off-the-floor surfaces such as draperies and walls, etc. are known in the art.

Typically, as exemplified in Snider, U.S. Pat. No. 2,333,494, an access port is provided in the hood of the cleaner head in the vicinity of a rotary beater. A hinged door is biased to sealingly close the port for normal, on-the-floor cleaning operation. To divert the suction path through any of a variety of nozzle attachments, a converter, with a fitting to accept a suction hose, is introduced to the port, deflecting the door about the pivot and intersecting an air passageway between a chamber surrounding the beater and the suction fan. The converter is configured to be in seating and sealing relationship with the air passageway so that the path between the air passageway and agitator chamber is obstructed. The end of the converter in the port has an opening to communicate uninterruptedly between the suction hose and the suction fan.

A serious deficiency of Snider is the requirement that the converter itself be responsible for sealing the passageway from the agitator chamber for off-the-floor operation. Any leakage in the converter diminishes suction in the accessory, reducing its effectiveness.

It can be seen that to maintain the seal in Snider, the bottom of the converter is angled to flushly engage the bottom wall of the air passageway and at the same time an intermediate region of the converter is abutted at a forward edge of the fan chamber. Insertion of the converter is accomplished by deflecting the door with the leading edge of the converter guiding the converter through the port and interiorly of the air passageway. After repeated assemblies, the leading edge may be so deformed that an incomplete seal is formed with the housing at the bottom of the air passageway. In this condition, outside air is drawn through the agitator chamber so that suction is reduced in the accessory.

Another drawback with Snider is that the converter is maintained in position solely by frictional forces. There is no structure disclosed to prevent separation of the sealing end of the converter from the housing, which may well occur in use as the user manipulates the suction hose attached to the converter.

Humphrey, U.S. Pat. No. 2,686,331, discloses a catch mechanism to maintain a converter in seated, sealing relationship with the suction cleaner housing. A pivoting arm has an integral nose engaging in a detent in the converter. The arm is associated with the forward wheels of the suction cleaner and is operable to simultaneously raise the cleaner head hood to disengage the rotary agitator from the floor and lock the converter in position. The latching assembly for the converter is complicated and not capable of operation independently of the wheel mechanism.

SUMMARY OF THE INVENTION

The present invention is directed to overcoming the problems enumerated above in a novel and simple manner.

More specifically, according to the invention, a hose attachment port is provided in the cleaner head hood of an upright suction cleaner. A hinged door is biasably seated by means of a spring against the underside of the hood to seal the port for normal, on-the-floor cleaning operation. With the door so arranged, dirt laden air from the agitator chamber is drawn uninterruptedly through passageway and exhausted into a collector bag.

Introduction of a converter through the hose attachment port pivots the door against the spring force to a second position wherein the door completely seals off the agitator chamer from the air passageway so that suction is entirely through the converter and the attached accessory. The converter is thus responsible for situating the door to divert the suction path. The surface of the door sealing off the agitator chamber is not contacted by the converter during assembly so that the sealing surface remains true even after numerous assemblies. Further, the surface of the converter encountering the door is configured to afford a minimal contact area and is rounded to smoothly guide the converter and reduce abrasion during assembly.

It is another object of the invention to afford an easily actuated and positive latch for the converter in an assembled state. To accomplish this, an integral peripheral shoulder is provided on the converter body to abut the top portion of the hood about the port. A stiff, but deformable strap is provided at the inside surface of the converter and is fixedly attached at one end so as to bias the opposite, free end releasably against the inside wall of the converter. The free end of the strap has a rounded nose and a locking shoulder for engagement with the underside of the hood. The nose encounters the hood and deflects the strap upon introduction to the port. The residual forces in the strap cause the shoulder to seat beneath the hood which is closely captured between the shoulders on the strap and converter, with the converter fully seated. A release button is integral with the strap intermediate its length and protrudes through the body of the converter. The button can be depressed to manually disengage the shoulder from beneath the hood so that the converter can be withdrawn.

BRIEF DESCRIPTION OF THE DRAWINGS

FIG. 1 is a perspective view of an upright suction cleaner embodying a preferred form of the invention;

FIG. 2 is a fragmentary, sectional view of the cleaner head hood along line 2—2 of FIG. 1, with the suction cleaner in normal, on-the-floor operating condition;

FIG. 3 is a fragmentary, sectional view of the cleaner head hood of FIG. 2, with a converter inserted for off-the-floor cleaning operation;

FIG. 4 is a perspective view of a spring for biasing a door which is pivoted upon introduction of the converter;

FIG. 5 is an exploded, fragmentary perspective view of the cleaner head hood disclosing the suction air path during on-the-floor cleaning operation; and FIG. 6 is a perspective view of the converter in FIGS. 1–3.

DETAILED DESCRIPTION OF THE DRAWINGS

FIGS. 1–5 depict a conventional, upright, suction cleaner at 9 to which the present invention is adaptable. The suction cleaner comprises a cleaner head hood 10 made up of a two-part housing 12,13 with internal partitions 14 defining a lateral chamber 16 housing a rotary agitator 18 and an air passageway 20 communicating between the chamber 16 and an exhaust duct 22 through which dirt laden air is introduced to a collecting bag 24. The exhaust duct 22 terminates in a swivel connection 25 to engage the fan housing (not shown).

The basic hood structure is conventional, including the curved seats 26 in the housing 13 which accept the cylindrical roller body 28 on the agitator and the suction creating fan (not shown) which establishes the path for the dirt laden air as indicated by the arrows in FIG. 5 which demonstrates on-the-floor cleaning operation. The suction cleaner is made ambulatory by the provision of wheels 30, mounted in conventional manner on the housing 13.

Off-the-floor cleaning is accomlished by fitting an accessory 32 to the hood 10 with the operating handle 37 raised to disengage the agitator from the supporting surfaces. A typical accessory 32, as shown in FIG. 1, includes a flexible hose 34 with a brush attachment 36 and a converter 38 for assembly with hood 10.

The converter 38, as detailed in FIG. 6, has a squared cross section corresponding to that of a hose attachment port 40 in the hood 10 which receives the converter 38. The converter is thus effectively keyed against inadvertent rotation about its longitudinal axis in the hood 10. The converter 38 has a cup-shaped body 41 with a fitting 43 for accepting the end of the suction hose 34 and three integral walls cooperatively defining a chamber 45 in communication with the inside of the body and including two laterally spaced side walls 42 connected by a curved rear wall 44. The rear corners 46 of the side walls remote from the body 41 are curved as are the front corners 48 of the side walls 42. The configuration of the walls 42, 44 is such as to facilitate entry of the converter into the port 40 without interference and to gradually and smoothly deflect a hinged door 50 to its off-the-floor cleaning position as shown in FIG. 3.

The door 50 is hinged about a laterally extending pivot pin 52 at the rear edge of the door. A U-shaped spring 54 has legs 56 with intermediate coils 58 which closely surround the pivot pin 52. The free ends 60 of the spring 54 bear against abutting surfaces 53 formed in the housing so that the spring can be preloaded to bias the door to its closed position as shown in FIG. 2.

For on-the-floor cleaning operation, a first planar surface 62 of the door 50 is seated sealingly against the peripheral edge 64 of the port 40 on the underside of the housing 12. With the door in this position, the dirt particles dislodged by the agitator 28 are entrained in the air flow which follows the path of the arrows in FIG. 2 to ultimate deposit in the collecting bag 24. To maintain a positive seal about the port 40, a gasket 66 is disposed on at least one of the door surface 62 and the underside 68 of the housing and is compressed therebetween with the door closed.

It can be seen that upon engagement of the free edge 70 of the converter with the door surface 62, and under an applied force, the converter overcomes the force of spring 54 and deflects the door in a counterclockwise direction about the pivot 52. The corners 46, 48 and the tapered nature of the sidewalls 42 permit angular insertion of the converter and make the converter self-centering.

With the converter 38 in a fully seated position, free edge 70 thereof abuts bottom surface 72 of the housing 13 bounding air passageway 20. The converter is shown fully seated in FIG. 3. The longitudinal of side walls 42 urges the door 50 against a forwardly facing shoulder 74 extending peripherally about air passageway 20 so as to effect an airtight seal and completely close off communication of air between the chamber 16 and the air passageway 20. To assure that the seal is airtight, a gasket 76 is attached to at least one of second surface 78 of the door and the shoulder 74 and is compressed therebetween with the door disposed as shown in FIG. 3. The air path is diverted from that shown by the arrows in FIG. 2 to that shown in FIG. 3 wherein the air is drawn entirely through the hose 34 so that the full suction force from the suction creating fan (not shown) is realized at the brush attachment 36.

The desired diversion of the air flow is effected entirely by repositioning of the door, with a positive seal maintained by the engagement between the surfaces 62, 78 respectively with the underside surface 68 and shoulder 74. Because the sealing surfaces of the door do not make substantial contact with the converter, the surfaces remain true and in conjunction with the gaskets afford a long life, positive seal that is not realized in the art.

It is another aspect of the invention to positively locate, but removably maintain, the converter assembled with the hood 10. To accomplish this, body 41 is provided with an enlarged peripheral surface 80 defining a downwardly facing shoulder 82, provided with a resilient sealing gasket 82*a*, shown in FIGS. 3 and 6, which seats against the upper surface 84 of the housing 12 to positively effect a seal simultaneously with the free edge 70 of the side walls abutting the bottom surface of the passageway 20. To maintain the converter in position, a latch means is provided generally at 86 as seen in FIG. 6.

The latch means 86 comprise a rectangular strap 88 facially engaging the inside, flat, forward surface 90 of the body 41. The strap is rigidly secured, as by a rivet 92 to the wall 90 and has some inherent flexibility which allows the free end of the strap to be deformed rearwardly away from the wall 90. The free end 94 of the strap is rounded and defines an upwardly facing shoulder 96. With the converter partially introduced to the port, the rounded nose 98 of the strap 88 engages the forward edge 100 about the port and deflects the strap rearwardly sufficiently to allow the nose to clear the edge 100. The strap is guided and deflected in turn by the edge 102 of a lower partition 104. As the nose 98 traverses beyond the edge 102, the strap assumes its original undeflected state and seats the shoulder 96 firmly beneath the underside 106 of the partition 104 to prohibit withdrawal of the converter.

To permit manual release of the converter, a button 108 is integrally formed with the strap intermediate its ends and protrudes through an aperture 110 in the wall 90 of the body 41. By depressing the button 108, the free end of the strap is deflected rearwardly to clear the shoulder 96 from beneath the partition 104 and allow withdrawal of the converter.

It can be seen that the converter can be simply, with one motion, fitted into and accurately located in the hood by means of the cooperation of the edge 70, surface 72 and shoulder 82 against the upper surface 84, and positively maintained therein by latch means 86. Removal of the converter is effected simply by depressing the button 108 and drawing upwardly upon the converter.

Thus, the invention accomplishes the provision in a vacuum cleaner defining a suction flow path between a dirt pickup position and a suction-applying position, means for selectively providing an alternate flow path opening to the suction flow path intermediate the positions comprising blocking means for selectively fully sealingly closing suction flow at an intermediate position intermediate the dirt pickup and suction-applying positions, a duct having a connection end, connecting means for connecting the duct in fluid flow communication with the suction flow path intermediate the suction-applying position and intermediate positions, connecting means for causing blocking means to fully close suction flow path at the intermediate position as an incident of the connecting means being connected in the fluid flow communication with the suction flow path, and control means for causing the blocking means to automatically prevent loss of suction from the suction flow path upon discontinuation of the duct connecting means therefrom.

In the illustrated embodiment, the blocking means comprises a wall element, and means for movably mounting the wall element to the means defining the suction flow path and the connecting means defining an opening through the means defining the suction flow path, and means on the duct end for engaging the wall element when inserted through the opening, and the control means comprises means for causing the wall element to sealingly close the opening in the absence of the connecting means being inserted through the opening.

Still further, in the illustrated embodiment, the blocking means comprises a wall element, and means for movably mounting the wall element to the means defining the suction flow path, the connecting means defining an opening through the means defining the suction flow path, and means on the duct end for engaging the wall element when inserted through the opening, and the control means comprises biasing means for causing the wall element to sealingly close the opening in the absence of the connecting means being inserted through the opening, the means on the duct end comprising an end wall arranged to retain the wall element sealingly closing the suction flow path as an incident of the wall being inserted through the opening, the end wall defining a transverse opening facing away from the wall element for providing free fluid flow from the duct to the suction flow path intermediate the wall element and the suction-applying means when the end wall is so inserted.

It should be understood that the foregoing detailed description was made for purposes of illustrating the structure of the present invention and its utility and no unnecessary limitations should be derived therefrom.

I claim:

1. In an on-the-floor cleaning suction cleaner of the type having a suction-generating means, a dirt collecting member and a cleaner head hood defining a hose attachment port, a chamber for a rotary agitator and an air passageway for communicating dirt laden air between the chamber and the dirt collecting member, an improved structure for converting the suction cleaner to off-the-floor operation comprising:

a converter connected to a suction hose for insertion into the hose attachment port;

a door pivotally mounted with respect to the cleaner head hood and movable between a first position wherein the door seals the hose attachment port and a second position wherein the door fully blocks air communication between the chamber and the air passageway; and means on the converter engageable directly against the door for deflecting the door towards the second position as the converter is inserted into the hose attachment port; and means on the converter directly rigidly engaging the door and bearing the door into the second position to positively retain the door in a blocking position between the chamber and the air passageway, whereby suction developed by the suction-generating means is realized entirely at the hose attachment port with the door in the second position.

2. An improved suction cleaner according to claim 1 wherein a peripheral edge is provided about the port, a surface of the door fits flushly with the peripheral edge, a resilient casket is disposed to at least one of the peripheral edge or door surface and spring means bias the door into the first position so that the resilient gasket is compressed between the peripheral edge and door surface with the door in the first position to provide an airtight seal over the port.

3. An improved suction cleaner according to claim 1 wherein a peripheral shoulder is provided about the air passageway, a surface of the door fits flushly with the peripheral shoulder, a resilient gasket is disposed on at least one of the peripheral shoulder or door surface and said means bearing the door into the second position cause the gasket to be compressed between the peripheral shoulder and door surface with the converter in a fully seated position and the door in the second position to enhance the seal therebetween.

4. An improved suction cleaner according to claim 1 wherein said converter has a leading edge to directly engage and deflect the door between said first position and said second position as the converter is extended into said port.

5. An improved suction cleaner according to claim 1 wherein means are provided to releasably lock the converter in the port.

6. An improved suction cleaner according to claim 1 wherein a peripheral edge is provided about the port, a surface of the door fits flushly with the peripheral edge and a resilient gasket is disposed on at least one of the peripheral edge or door and is compressed between the peripheral edge and door with the door in the first position to enhance the seal therebetween, said converter comprising a cup-shaped body and a wall portion integral with the cup-shaped body and defining a second chamber and an opening communicating between the second chamber and said air passageway with the converter in a fully seated position.

7. In an on-the-floor suction cleaner of the type having a suction-generating means, a dirt collecting member and a cleaner head hood defining a hose attachment port, a chamber for a rotary agitator and an air passageway for communicating dirt laden air between the chamber and the dirt collecting member, an improved structure for converting the suction cleaner to off-the-floor operation comprising:

a door pivotally mounted with respect to the hood and movable between a first position wherein the door seals the hose attachment port and a second position wherein the door bears on a set about the air passageway and substantially prevents any communication of air between the chamber and the air passageway, whereby suction developed by the suction-generating means is realized entirely at the hose attachment port with the door in the second position;

a converter connected to a suction hose for insertion into the hose attachment port, said converter being constructed so that upon insertion thereof into the hose attachment port, the door is directly contacted by the converter and is moved from the first to the second position;

a resilient gasket on one of either the seat or the door and captured between the seat and the door with the door in the second position; and latch means for releasably locking the converter to the cleaner head hood in a fully seated position wherein the gasket is compressed between the door and seat to enhance the seal established between the door and the seat.

8. An improved suction cleaner according to claim 7 wherein said converter has a peripheral shoulder, a second resilient gasket is provided on one of either the head hood and with said latch means locked the second resilient gasket is compressed between the shoulder and hood so that a tight seal is established between the converter and said hood at the hose attachment port in the fully seated position.

9. An improved suction cleaner according to claim 7 wherein the converter has a peripheral shoulder for engaging the cleaner head hood, said latch means has a strap with a deflectable free end defining a shoulder and said shoulders on the converter and strap free end cooperatively capture the cleaner head hood to secure the converter to the cleaner head hood.

10. A converter for connecting a suction hose to an attachment port in the cleaner head hood of a suction cleaner comprising:

a cup-shaped body having a peripheral wall defining a peripheral shoulder surface;

a resilient gasket on the shoulder;

a wall portion integral with the body and defining a chamber and a suction opening; and a strap secured at one end with the body and having a free end with a curved nose and a shoulder facing the shoulder surface on the body, said nose being arranged to deflect the free end of the strap as the converter is inserted into the port and the free end assumes its undeformed state and the hood and gasket are closely captured between the shoulder surface on the body and the shoulder on the strap free end with the converter in a fully seated position, said gasket being compressed with the converter in the fully seated position to effect a positive seal between the converter and cleaner head hood.

11. A converter according to claim 10 wherein said body has an inside surface and said strap is secured at the inside surface.

12. A converter according to claim 10 wherein said wall portion has a non-circular cross section and said port has a cross section closely mating with the port so that the converter is positively keyed in the port.

13. A converter according to claim 10 wherein a button is provided on said strap intermediate its ends to manually release the shoulder at the free end of the strap from the hood so that the converter can be withdrawn.

14. A converter according to claim 10 wherein said wall portion comprises spaced, parallel side walls tapering towards a free end and a rear wall connecting between the side walls, said suction opening residing opposite said rear wall.

15. In a vacuum cleaner having means defining a suction flow path between a dirt pickup position and a suction-applying position, means for selectively providing an alternate flow path opening to said suction flow path intermediate said positions, said means comprising:

blocking means for selectively fully sealingly closing said suction flow at an intermediate position intermediate said dirt pickup and suction-applying positions;

a duct having a connection end;

connecting means for connecting the duct in fluid flow communication with said suction flow path intermediate said suction-applying position and said intermediate positions;

means on said connecting means for causing said blocking means to fully close said suction flow path at said intermediate position as an incident of said connecting means being connected in said fluid flow communication with said suction flow path;

said connecting means bearing directly rigidly against said blocking means with said fluid flow communication established; and control means for causing said blocking means to automatically prevent loss of suction from said suction flow path upon discontinuation of said duct connecting means therefrom.

16. The vacuum cleaner of claim 15 wherein said blocking means comprises a wall element, and means for movably mounting said wall element to said means defining said suction flow path.

17. The vacuum cleaner of claim 15 wherein said blocking means comprises a wall element, and means for movably mounting said wall element to said means defining said suction flow path, said connecting means defining an opening through said means defining said suction flow path, and means on said duct end for engaging said wall element when inserted through said opening, and said control means comprises means for causing said wall element to sealingly close said opening in the absence of said connecting means being inserted through said opening.

18. The vacuum cleaner of claim 15 wherein said blocking means comprises a wall element, and means for movably mounting said wall element to said means defining said suction flow path, said connecting means defining an opening through said means defining said suction flow path, and means on said duct end for engaging said wall element when inserted through said opening, and said control means comprises biasing means for causing said wall element to sealingly close said opening in the absence of said connecting means being inserted through said opening.

19. The vacuum cleaner of claim 15 wherein said blocking means comprises a wall element, and means for movably mounting said wall element to said means defining said suction flow path, said connecting means defining an opening through said means defining said suction flow path, and means on said duct end for engaging said wall element when inserted through said opening, and said control means comprises biasing means for causing said wall element to sealingly close said opening in the absence of said connecting means being inserted through said opening, said means on the duct end comprising an end wall arranged to retain said wall element sealingly closing said suction flow path as an incident of said end wall being inserted through said opening, said end wall defining a transverse opening facing away from said wall element for providing free fluid flow from said duct to said suction flow path intermediate said wall element and said suction-applying means when said end wall is so inserted.

20. A converter according to claim 7 wherein said converter has a bottom edge which directly contacts the door upon the converter being directed into the port, means on the converter directly contact the door and bear the door into the second position with the converter in a fully seated position and said bottom converter edge abuts a portion of the cleaner head hood with the converter in the fully seated position and stabilizes the converter.

* * * * *

UNITED STATES PATENT AND TRADEMARK OFFICE

CERTIFICATE OF CORRECTION

PATENT NO. : 4,563,790

DATED : January 14, 1986

INVENTOR(S) : Paul M. Clark

It is certified that error appears in the above-identified patent and that said Letters Patent is hereby corrected as shown below:

Column 6, line 23 (Claim 2, line 4), after "resilient" cancel "casket" and substitute therefor --gasket--; and after "disposed" cancel "to" and substitute therefor --on--;

Column 6, line 35 (Claim 3, line 7), change the first word "cause" to --causes--; and Column 7, line 2 (Claim 7, line 12), before "about" cancel "set" and substitute therefor --seat--.

Signed and Sealed this

Twenty-fourth Day of March, 1987

*Attest:*

DONALD J. QUIGG

*Attesting Officer* *Commissioner of Patents and Trademarks*